US008960116B2

(12) United States Patent
van der Velde et al.

(10) Patent No.: US 8,960,116 B2
(45) Date of Patent: Feb. 24, 2015

(54) DUAL DRAFT CRANE VESSEL

(75) Inventors: Willem Jacob van der Velde, Rockanje (NL); Willem Johannes Alain Wassink, Vlaardingen (NL); Johan Albert Commandeur, Zwijndrecht (NL)

(73) Assignees: GustoMSC Resources B.V., Schiedam (NL); Seaway Heavy Lifting Engineering B.V., Zoetermeer (NL)

( * ) Notice: Subject to any disclaimer, the term of this patent is extended or adjusted under 35 U.S.C. 154(b) by 1666 days.

(21) Appl. No.: 12/097,540

(22) PCT Filed: Dec. 14, 2006

(86) PCT No.: PCT/NL2006/050317

§ 371 (c)(1),
(2), (4) Date: Aug. 18, 2008

(87) PCT Pub. No.: WO2007/069897

PCT Pub. Date: Jun. 21, 2007

(65) Prior Publication Data

US 2008/0295756 A1 Dec. 4, 2008

(30) Foreign Application Priority Data

Dec. 14, 2005 (EP) ..... 05112166

(51) Int. Cl.
*B63B 1/04* (2006.01)
*B63B 35/44* (2006.01)
*B63B 35/03* (2006.01)

(52) U.S. Cl.
CPC . *B63B 35/44* (2013.01); *B63B 1/04* (2013.01); *B63B 35/03* (2013.01)
USPC ..... 114/125; 114/56.1

(58) Field of Classification Search
USPC ..... 114/56.1, 61.27–61.29, 125
See application file for complete search history.

(56) References Cited

U.S. PATENT DOCUMENTS

| | | | | | |
|---|---|---|---|---|---|
| 860,492 | A | * | 7/1907 | Mehrtens | 114/125 |
| 4,100,873 | A | * | 7/1978 | Kaldenbach | 114/125 |
| 4,165,702 | A | * | 8/1979 | Lloyd et al. | 114/65 R |
| 4,166,426 | A | * | 9/1979 | Lloyd, III | 114/65 R |
| 4,230,420 | A | * | 10/1980 | Chow | 405/166 |
| 5,832,855 | A | | 11/1998 | Gellekink et al. | |

FOREIGN PATENT DOCUMENTS

| | | | |
|---|---|---|---|
| FR | 339 700 | A | 1/1904 |
| FR | 475 099 | A | 7/1914 |
| GB | 2 326 923 | A | 1/1999 |
| JP | 53-121389 | A | 10/1978 |
| NL | 8 403 467 | A | 6/1986 |

* cited by examiner

*Primary Examiner* — Edwin Swinehart
(74) *Attorney, Agent, or Firm* — Young & Thompson

(57) ABSTRACT

Vessel including a hull of a substantially closed surface has at deck level a lifting crane, ballast tanks within the hull and a ballast control unit for admitting water to the ballast tanks for changing the draft of the vessel. The hull has a narrow lower section having first width over a height from keel level to a widening level, and a top section having a larger width than the lower section, extending from the widening level upwards towards deck level. The control unit is adapted to ballast the vessel to have a relatively shallow draft level in a transit mode, so that the wide top section is above water level, while the vessel is traveling, and to ballast the vessel to a relatively deep draft level in a lifting mode so that the widening level is below water level, at least when the vessel is substantially stationary and the crane is in its lifting position.

20 Claims, 5 Drawing Sheets

DUAL DRAFT CRANE VESSEL

BACKGROUND OF THE INVENTION

1. Field of the Invention

Figure 1:
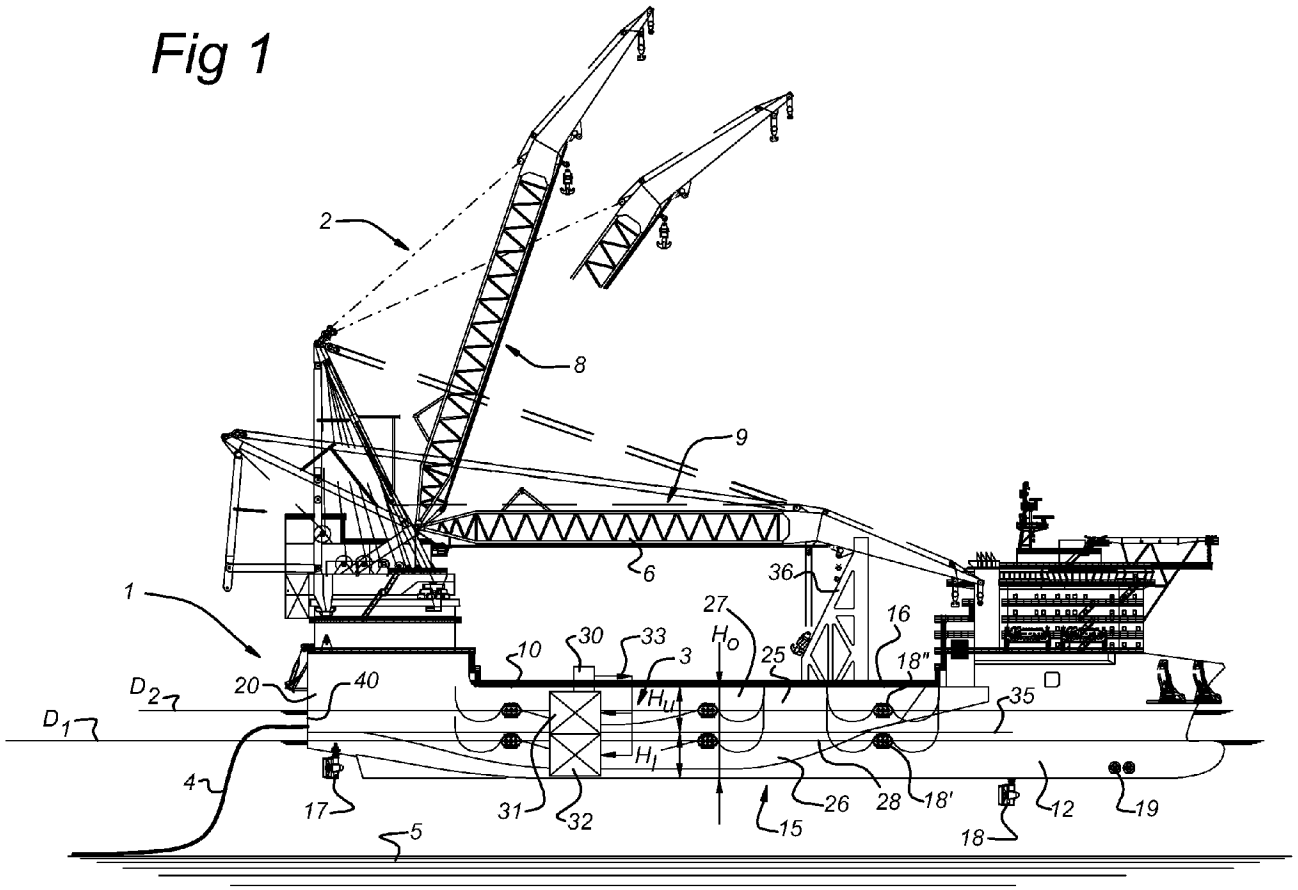

The invention relates to a vessel comprising a hull of a substantially closed surface having at deck level a lifting crane, ballast tanks within the hull and a ballast control system for admitting water to the ballast tanks for changing the draft of the vessel.

2. Description of the Related Art

It is known to float offshore constructions, such a support structures for semi-submersible platforms, to their deployment site a relatively shallow draft level, while the semi submersible support structure is towed by one or more tugs. The support structure comprises two parallel, substantially horizontal ballastable buoyancy bodies and vertical support columns resting on the buoyancy bodies. At the deployment site, the support structure is ballasted to a relatively deep draft level, such that a stable configuration with a low centre of gravity is obtained. A superstructure carrying hydrocarbon processing and/or exploration equipment and crew quarters is attached to the columns of the support structure by a crane at a safe distance above water level.

Lifting barges for lifting the superstructures of oil or gas platforms may have a lifting capacity of 1200 tons or over, and need to operate at calm seas. The lifting barges are relatively wide for increased stability. This increased width however makes these barges susceptible to wave moments as the natural frequency of these wide vessels is close the average wave period of about 7-8 s. Hence the known lifting vessels and barges have a limited operating window will be subject to undesired roll motions under all conditions.

SUMMARY OF THE INVENTION

It is therefore an object of the present invention to provide a lifting vessel with improved sailing properties and reduced roll motions. It is a further object of the invention to provide a lifting vessel which can be employed for pipelaying or lift preparation or general construction operation at relatively high sea. It is again a purpose of the present invention to provide a multi-purpose lifting vessel which has a large operating window and limited down time.

Hereto the vessel of the present invention is characterized in that the hull has a narrow lower section having a first width extending over a height from keel level to a widening level, and a top section having a larger width than the lower section, extending from the widening level upwards towards deck level, wherein the ballast control system is adapted to ballast the vessel to have a relatively shallow draft in a shallow draft mode, so that the wide top section is above water level and to ballast the ship to a relatively deep draft level in a lifting mode such that the widening level is below water level, at least when the vessel is substantially stationary and the crane is in its lifting position.

When the vessel is deballasted, the water line will be defined by the narrow lower section, such that the vessel has favorable motional behavior in shallow draft mode for higher transit speed and operational (other than lifting) conditions. Preferably operational roll periods will be higher than 12 s, preferably higher than 14 s. During transit, the crane can be in a substantially horizontal transit position, the arm extending along deck level. Operational speeds of for instance 15 knots or more are achieved. Also preparation activities prior to lifting heavy objects (inclusive of operation of the crane for the handling of smaller loads) can be carried out in the shallow draft mode of the vessel with reduced roll motions, during which the vessel may be substantially stationary, moored, under dynamic positioning or sailing at relatively low speeds. In this way, the operational window is increased compared to crane vessels that can only be operated at a single, relatively large width.

During lifting operations, the vessel is substantially stationary and is ballasted such that the relatively wide section is at submerged, for instance between 2 m and 3 m below water level. The arm of the crane is placed upwards and loads of for instance up to 5000 tons can be lifted in a stable manner. In the lifting mode, the roll period is reduced compared to the transit mode to for instance about 10-12 s and comparable to known lift vessels and barges during lifting.

Preferably the hull has a generally T-shaped cross-section such that an abrupt change between the wide upper section and the narrower lower section is achieved and a change between the shallow draft mode and the lifting mode requires a relatively small change in draft level. The T-shaped cross-section also results in two clearly defined operational modes, which are not dependent on draft level, such as is the case for a hull which for instance has a gradual change in width when going from the lower section to the upper section of the vessel. The transverse parts of the T-shaped hull may for instance be formed by side extensions in longitudinal direction.

The vessel according to the invention may have a width at the lower section of between 0.6 and 0.9 times the width of the upper section, preferably between 0.6 times and 0.8 times, most preferably between 0.7 and 0.8 times the width of the upper section. The height of the upper section $H_u$ may be between 0.2 and 0.5 times the height $H_0$ from keel level to deck level, preferably between 0.2 and 0.4 times the height $H_0$, most preferably between 0.3 and 0.4 times the height $H_0$. The upper section of relatively large width comprises two longitudinal side extensions extending from the location of the crane on the vessel preferably between 0.5 and 0.9 times the length of the vessel $L_0$, more preferably between 0.6 and 0.8 times, most preferably between 0.7 and 0.8 times the length $L_0$. An example of a vessel according to the invention has an overall length of for instance 180 m, a width of the lower section of 36 m, a width of the upper section of 47 m and a height from deck level to keel level of 18 m.

The crane may be situated near the stern of the vessel such that in the transit mode the arm is supported on the deck of the vessel. In a preferred embodiment the vessel, next to having lifting capabilities, is laid out as a pipe-lay vessel, a pipe transporting trajectory extending in a length direction of the vessel below the crane. In the shallow draft mode, pipe segments can be connected and the pipe can be fed along the firing line to the sea bed. As the shallow draft mode results in reduced roll motions, the pipe lay operations can be continued under high sea states without the need to abandon the pipe. In one embodiment a pipe exit point is situated at the stem, the pipe transporting trajectory in the lifting mode being situated below water level, the exit point being closed by watertight doors. The firing line for the pipe is situated below deck level, leaving free area for voluminous deckloads on the deck. During lifting operations, the pipe exit point is sealed, for instance by a double watertight door.

In one embodiment according to the invention, lower ballast tanks are situated in the lower section and upper ballast tanks are situated in the upper section, the upper and lower ballast tanks being filled and emptied by the ballast control system, the upper ballast tanks providing an anti-heeling moment during lifting, while the lower ballast tanks being used for draft control. The separate ballast tanks situated at different levels allow optimal positioning of the centre of gravity and buoyancy of the vessel by the ballast control system, to be optimally adapted to the specific operation, be it transit, pipe laying or lifting.

A double deck is preferably supported on top of substantially flat ballast tanks, with the upper (working) deck at a distance from the top of the tanks. External reinforcement structures on the top of tank provide stiffness and stability. As no support structures have to be included inside the ballast tanks, no air is entrapped in air pockets inside the ballast tanks during ballasting, which results in water movement in the tanks being excluded by which improved stability is achieved. The double deck configuration also allows welding to the upper deck without damaging the anti-corrosion coating on the top of tank.

In one embodiment counterbalance means are provided on the crane for placing the centre of gravity of the crane and a relatively small load, on a vertical axis of rotation of the crane. In this manner, the crane can lift small loads, such as for instance up to 100 tons, without heel, when the vessel is in the transit mode, while having a rotational freedom of 360°.

BRIEF DESCRIPTION OF THE DRAWING FIGURES

Figure 2:
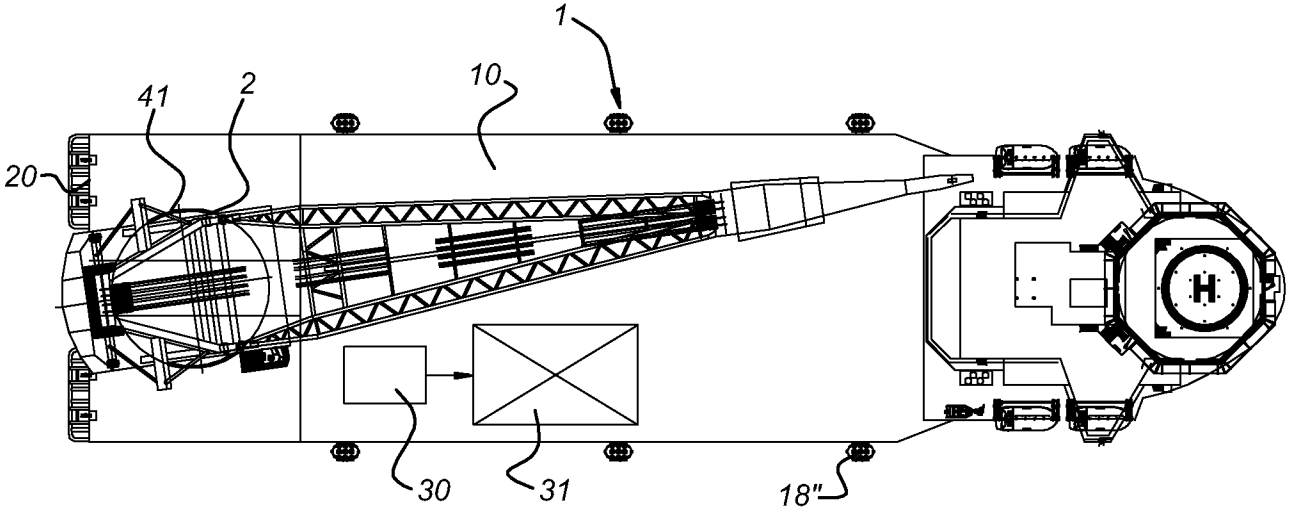
Figure 3:
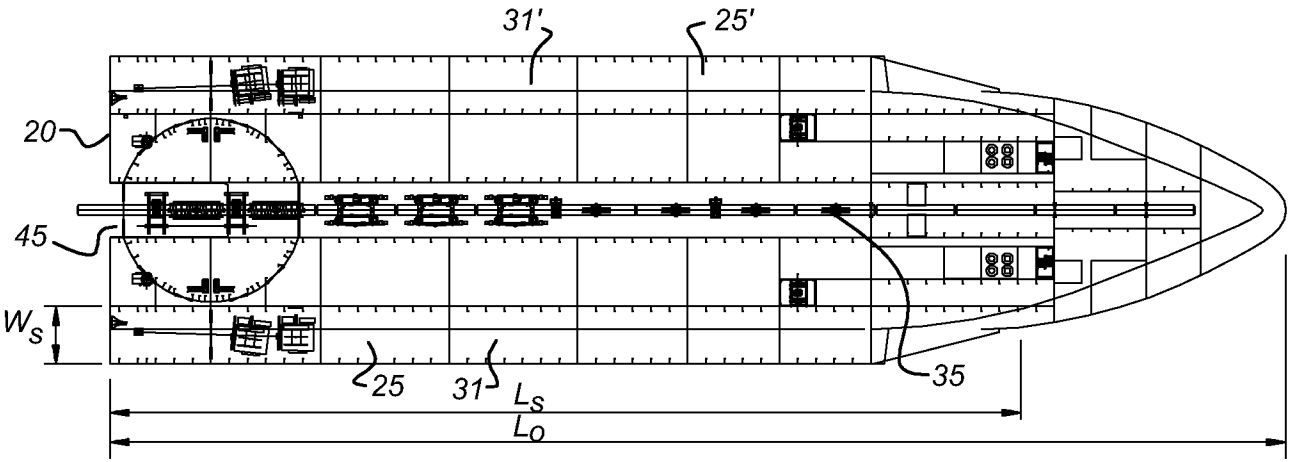
Figure 4:
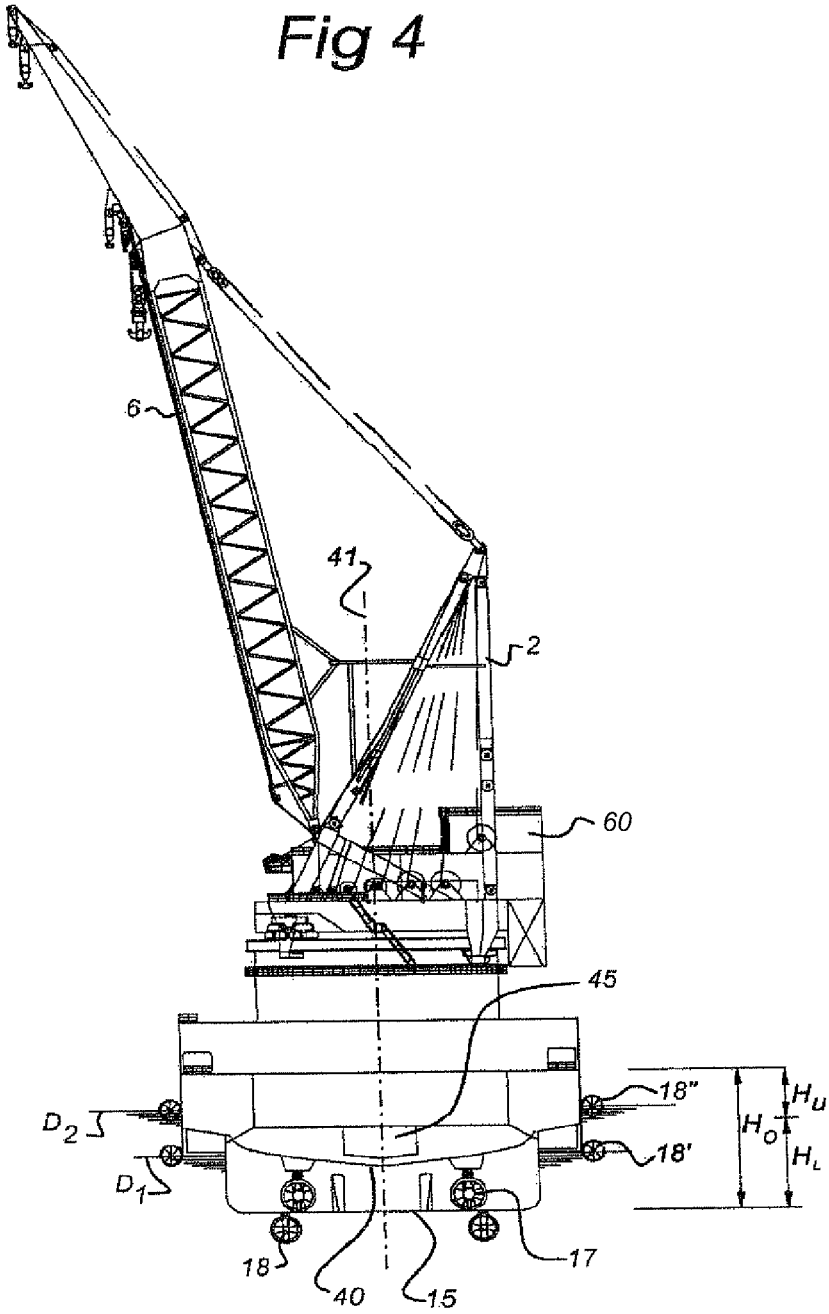
Figure 5:
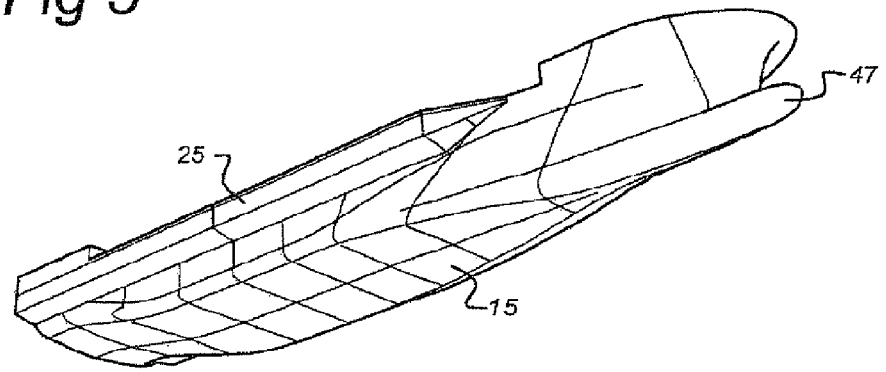
Figure 6:
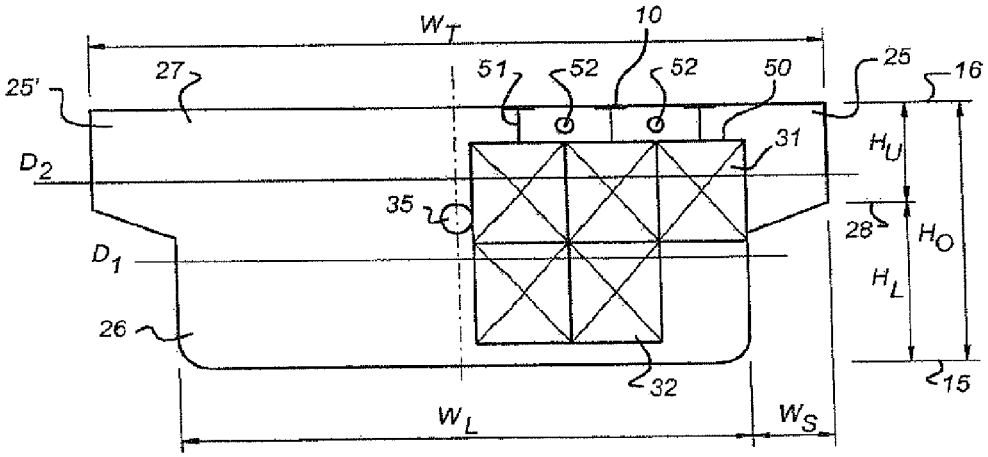
Figure 7:
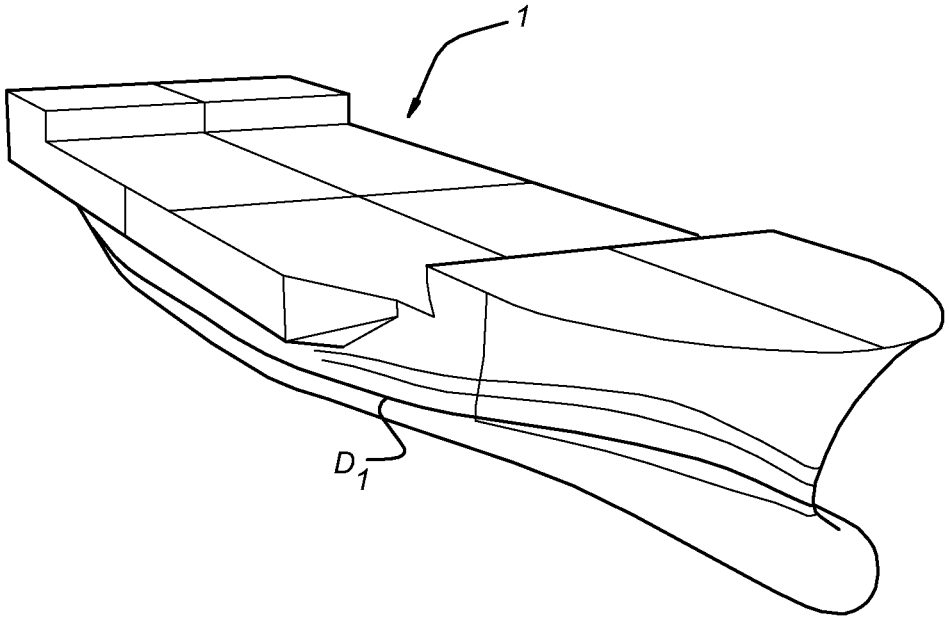
Figure 8:
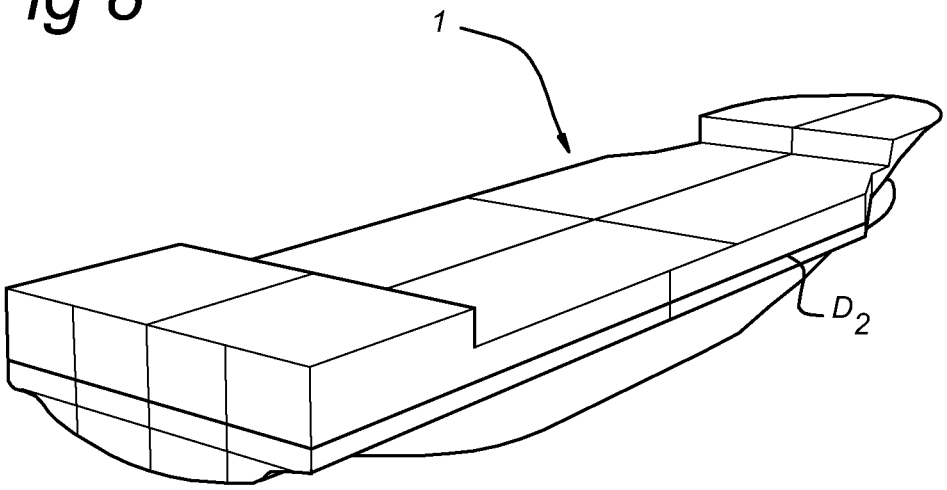

Some embodiments of a multi-purpose dual draft lifting and pipe-lay vessel according to the present invention will be explained in detail with reference to the accompanying drawings. In the drawings:

FIG. 1 shows a side view of a dual draft pipelay and lifting vessel according to the invention, FIGS. 2 and 3 show a top view of the top deck and of the pipe lay deck respectively of the vessel of FIG. 1, FIG. 4 shows a rear view of the vessel of FIG. 1, FIG. 5 shows a perspective bottom view of a vessel according to the invention, FIG. 6 shows a schematic transverse cross-sectional view, and FIGS. 7 and 8 show perspective views of a vessel according to the invention in a lifting mode and in a shallow draft mode, respectively.

DETAILED DESCRIPTION OF THE INVENTION

FIG. 1 shows a lifting and pipe-lay multipurpose vessel 1 having a crane 2 on deck and a firing line 3 for laying of a pipe or cable 4 onto the seabed 5. The arm 6 of the crane 2 can be in a lifting position 8, in which is up righted or can be in the transit position 9, in which it extends generally parallel to the deck 10 of the vessel.

The hull 12 of the vessel is of a substantially closed surface. With "closed surface" is intended that the hull does not have a columnar structure piercing the waterline, but has as a water line a closed contour. The hull 12 has a relatively narrow lower section 26 of height $H_1$ and a relatively wide top section 27 of height $H_u$. The wide top section is formed by side extensions 25 extending from a widening level 28 up to deck level 16. The total height of vessel 1 between keel level 15 and deck level 16 is indicated as $H_0$.

At keel level 15, the vessel is at the stem 20 provided with thrusters 17 for propulsion and with thrusters 18 and 19 for dynamic positioning and station keeping. Fenders 18' and 18" are situated at the different draft levels D1, D2 for distance keeping both in the transit mode and in the lifting mode.

Schematically indicated is a draft control system 30, comprising computing means and a data input device, which controls pumps supplying water to upper and lower ballast tanks 31,32, as schematically indicated by line 33 signifying an electrical or electro-optical control line. By the draft control system 30, the ballast tanks 31, 32 can be selectively filled to obtain a shallow draft level D1 in which the wide top section 27 is above water level. At the draft level D1, the firing line 35 for laying of pipes 4 is above water level. In transit at draft level D1, the crane 2 is in a locked position in which the arm 6 rests on a support 36. In operational situations at draft D1 the crane 2 can be in use with the arm 6 elevated. The tanks 31, 32 are ballasted in such a manner that optimal roll behavior during pipe laying is obtained. The ballast tanks 31 extend along the whole length of the side extensions 25.

Upon ballasting of the tanks 32 by the ballast control system 30 to the lifting a draft level D2, the side extensions 25 of the wide top section 27 are partly submerged, for instance over a depth of 2 m. The firing line 35 is now situated below water level, the stern exit opening 45 of the firing line being closed off by a watertight door 40. Now the arm of the crane 2 can be raised, and loads can be lifted. Dynamic ballasting compartments 31 are present within the hull 12 to form a counterbalance for the load and to prevent heeling, the compartments being filled under control of the ballast control system 30, depending on the angular position of the crane 2.

FIG. 2 illustrates the crane deck 10, the crane being rotated slightly around its vertical axis of rotation 41. Dynamic ballast tanks 31,31' which extend in the rear section 45, are filled or emptied under control of the ballast control system 30 to prevent heel of the vessel upon lifting of a load.

In FIG. 3, the firing line 35 for the pipe-lay operations is shown, the pipe exiting the vessel 1 at the stern 20 via exit opening 45 (over a stinger construction which is not shown in the drawing). The side extensions 25, 25' comprise ballast tanks 31, 31' and extend along a length $L_s$ of for instance 134 m, at a total length $L_0$ of the vessel 1 from bow 47 to stern 20 of 183 m.

As can be seen from FIG. 4, the crane 2 comprises a ballast unit 60 which is used to maintain the centre of gravity of the crane and small loads, for instance up to 100 tons, on the vertical rotation axis 41, such that a 3600 rotation under small load handling at zero heel is possible for the shallower draft level D1. As shown in FIG. 4, the exit opening 45 is below water level at the lifting draft level D2, and is in that case closed by a watertight door 40. The height of deck level H0 is for instance 18 m meter, the height Hu of the side extensions 25 at midship for instance 6 m. The lower part of the side extensions is situated at a height H1 of for instance 9 m, and the side extension width Ws is for instance 5 m.

FIG. 5 gives a general overview of the hull shape of the vessel of the present invention. As can be seen in FIG. 6, the main working deck 10 is supported at a distance from the flat top 50 of the tanks 31, via girders 51. In the space between the deck 10 and the top 50 of the tanks, which may have a height of for instance 2.1 m air ventilation pipes, 52, 53 are situated. Since the girders 51 are external of the ballast tanks 51, they provide reinforcement for said tanks without causing air entrapment at the top of the tanks, which air entrapment may lead to instabilities. Furthermore welding on the upper (working) deck is possible without damaging the anti-corrosion coating of the top of tanks. The lower section 26 can be seen to have a width W1 of for instance 35 m, whereas the top section 27 has a width Wt of 46 m, each side extension 25, 25 having a width Ws of 5.5 m.

Finally, FIGS. 7 and 8 schematically show the vessel 1 in a transit mode, at shallow draft level D1, and in the lifting mode, at deep draft level D2. It should be noted that although the examples refer for the shallow draft mode operation as pipe-laying, other operations may be envisaged such as lifting preparation, general construction and accommodation services.

The invention claimed is:

1. A single-hulled vessel, comprising:

a hull of a single substantially closed surface having at deck level a lifting crane; and, upper and lower ballast tanks within the hull and a ballast control unit for admitting water to the lower ballast tanks for changing a draft of the vessel, wherein the hull has a narrow lower section having first width over a height from keel level to a widening level, and a top section have a larger width than the lower section, extending from a widening level upwards towards deck level, the upper ballast tanks being situated in the top section, wherein the ballast control unit is adapted to ballast the lower ballast tanks to control the draft of the vessel so as to have a relatively shallow draft level in a transit mode, the crane extending substantially parallel to a deck and the wide top section is above water level while the vessel is traveling, and to ballast the vessel to a relatively deep draft level in a lifting mode such that the widening level is below water level, at least when the vessel is substantially stationary and the crane is in an upright lifting position, the upper ballast tanks being filled and emptied under control of the ballast control unit for providing an anti-heeling moment during lifting.

2. The vessel according to claim 1, wherein a transverse cross-section of the hull is of generally T-shaped form.

3. The vessel according to claim 1, wherein the width of the lower section is between 0.6 and 0.9 times the width of the top section.

4. The vessel according to claim 3, wherein a height of the top section is between 0.2 and 0.5 times a height from keel level to deck level.

5. The vessel according to claim 1, wherein the top section comprises two longitudinal side extensions extending from a location of the crane on the vessel between 0.5 and 0.9 times a length of the vessel.

6. The vessel according to claim 5, wherein a location of the side extensions create buoyancy at the location of the crane.

7. The vessel according to claim 1, wherein a pipe transporting firing line extends in a length direction of the vessel, below the crane.

8. The vessel according to claim 7, a pipe exit point being situated at a stern, the pipe transporting firing line in the lifting mode being situated below water level, the exit point being closed by an openable sealing member.

9. The vessel according to claim 1, further comprising a deck supported on substantially flat ballast tanks.

10. The vessel according to claim 1, wherein a ballast unit is provided on the crane for placing the centre of gravity of the crane and a relatively small load, on a vertical axis of rotation of the crane.

11. The vessel according to claim 1, which has low resistance properties at shallow draft levels resulting in a high transit speed or low fuel consumption during transit.

12. The vessel according to claim 2, wherein the width of the lower section is between 0.6 and 0.9 times the width of the top section.

13. The vessel according to claim 2, wherein the top section comprises two longitudinal side extensions extending from a location of the crane on the vessel between 0.5 and 0.9 times a length of the vessel.

14. The vessel according to claim 3, wherein the top section comprises two longitudinal side extensions extending from the location of the crane on the vessel between 0.5 and 0.9 times a length of the vessel.

15. The vessel according to claim 4, wherein the top section comprises two longitudinal side extensions extending from a location of the crane on the vessel between 0.5 and 0.9 times a length of the vessel.

16. The vessel according to claim 2, wherein a location of side extensions create buoyancy at the location of the crane.

17. The vessel according to claim 2, wherein a pipe transporting firing line extends in a length direction of the vessel, below the crane.

18. The vessel according to claim 2, further comprising a deck supported on substantially flat ballast tanks.

19. The vessel according to claim 1, wherein the width of the lower section is between 0.6 and 0.8 times the width of the top section.

20. The vessel according to claim 1, wherein a height of the top section is between 0.2 and 0.4 times a height from keel level to deck level.

* * * * *